US008393862B2

(12) United States Patent
Chen

(10) Patent No.: US 8,393,862 B2
(45) Date of Patent: Mar. 12, 2013

(54) CEILING FAN POSITIONING STRUCTURE FOR SHIELDING A HANGING PORTION OF A CEILING FAN

(76) Inventor: Chia-Teh Chen, Taipei (TW)

( * ) Notice: Subject to any disclaimer, the term of this patent is extended or adjusted under 35 U.S.C. 154(b) by 809 days.

(21) Appl. No.: 12/537,678

(22) Filed: Aug. 7, 2009

(65) Prior Publication Data

US 2011/0033309 A1 Feb. 10, 2011

(51) Int. Cl.
*F03B 11/02* (2006.01)

(52) U.S. Cl. ..... 415/213.1; 416/244 R

(58) Field of Classification Search ..... 415/213.1, 415/126, 128; 416/4, 1, 244 R
See application file for complete search history.

(56) References Cited

U.S. PATENT DOCUMENTS

| | | | | |
|---|---|---|---|---|
| 6,733,242 | B2 * | 5/2004 | Yung | 416/244 R |
| 7,300,248 | B2 * | 11/2007 | Wang | 416/5 |
| 2006/0263224 | A1 * | 11/2006 | Wang | 416/244 R |

* cited by examiner

*Primary Examiner* — Dwayne J White
(74) *Attorney, Agent, or Firm* — Muncy, Geissler, Olds & Lowe, PLLC

(57) ABSTRACT

A ceiling fan positioning structure includes a fixing frame, a decoration casing, a plurality of retaining mechanisms and a plurality of convex posts. The convex posts are disposed on the fixing frame and the retaining mechanisms are fixed on the decoration casing; alternatively, the convex posts are disposed on the decoration casing and the retaining mechanisms are fixed on the fixing frame. In addition, each retaining mechanism has a base seat and an elastic plate, the base seat has a channel and a chamber for receiving the elastic plate. Therefore, each convex post is received in the channel of each base seat. When the decoration casing is rotated, each convex post is moved into each chamber. When the decoration casing is rotated to a predetermined position, the position of each convex post is limited in each chamber by the elastic force of each elastic plate.

7 Claims, 9 Drawing Sheets

CEILING FAN POSITIONING STRUCTURE FOR SHIELDING A HANGING PORTION OF A CEILING FAN

BACKGROUND OF THE INVENTION

1. Field of the Invention

The present invention relates to a micro controller system, in particular, to a ceiling fan positioning structure for shielding a hanging portion of a ceiling fan.

2. Description of Related Art

Ceiling fan has been extensively applied to home life in order to enhance the aspect of room of house and efficiency of conduction current of room, according to the upgrade of living standard. Hence, the ceiling fan is favorable by consumers.

Referring to FIG. 1, in generally, the hanging portion 11 of the ceiling fan is fixed by the fixing frame 12. Hence, the ceiling fan is fixed on a ceiling by using the fixing frame 12. The fixing frame 12 is covered by a external casing 13 and the external casing 13 is fixed by matching the screw 14a and the fixing frame 12 in order to increase the aspect of the ceiling fan. In addition, a motor 15 of the ceiling fan is covered by a casing 16, and the screws 14b pass through the casing 16 to fix the casing 16 on a fixture 17 that is disposed on the motor 15. The motor 15 is cover by the casing 16 in order to increase the aspect of the ceiling fan.

Although the external casing 13 and the fixing frame 12 are fixed together and the casing 16 and the fixture 17 are fixed together by screwing, there are some following defects during the assembly of the ceiling fan:

Because the ceiling fan is assembled on the ceiling and above the assembler, it is inconvenient for assembler to assemble the ceiling fan essentially. When assembling the external casing 13 or the casing 16, the assembler needs to use one hand to hold the external casing 13 or the casing 16, and the assembler only can use another idle hand to screw the screws 14*a*, 14*b*. Hence, it is difficult for the assembler to use one hand to fix the external casing 13 on the fixing frame 12 or fix the casing 16 on the fixture 17 by using the screws 14*a*, 14*b*. In addition, when the assembler uses one hand to hold the external casing 13 or the casing 16, and the assembler cannot smoothly and quickly screw the screws 14*a*, 14*b* on the external casing 13 or the casing 16 by using another idle hand. Because the assembler cannot smoothly screw the screws 14*a*, 14*b* on the external casing 13 or the casing 16, the screws 14*a*, 14*b* would fall down easily during the assembly of the external casing 13 or the casing 16.

SUMMARY OF THE INVENTION

In view of the aforementioned issues, the present invention provides a ceiling fan positioning structure for shielding a hanging portion of a ceiling fan. It is convenient and simple for user to quickly and smoothly assemble the present invention.

To achieve the above-mentioned objectives, the present invention provides a ceiling fan positioning structure for shielding a hanging portion of a ceiling fan, including: a fixing frame, a decoration casing, a plurality of retaining mechanisms and a plurality of convex posts.

The convex posts are disposed on the fixing frame and the retaining mechanisms are fixed on the decoration casing; alternatively, the convex posts are disposed on the decoration casing and the retaining mechanisms are fixed on the fixing frame. In addition, each retaining mechanism has a base seat and an elastic plate, the base seat has a channel and a chamber for receiving the elastic plate, and the elastic plate has a pressing arm bent on an end thereof.

Therefore, the decoration casing covers the fixing frame, each convex post is received in the channel of each base seat. When the decoration casing is rotated, each convex post is moved towards each elastic plate and into each chamber, and each convex post touches each elastic plate in order to change the shape of each elastic plate. When each convex post is moved to touch each pressing arm and an inner wall of the chamber, the position of each convex post is limited between each pressing arm and the inner wall of each chamber by the elastic force of each pressing arm.

In order to further understand the techniques, means and effects the present invention takes for achieving the prescribed objectives, the following detailed descriptions and appended drawings are hereby referred, such that, through which, the purposes, features and aspects of the present invention can be thoroughly and concretely appreciated; however, the appended drawings are merely provided for reference and illustration, without any intention to be used for limiting the present invention.

DETAILED DESCRIPTION OF THE PREFERRED EMBODIMENTS

Figure 1:
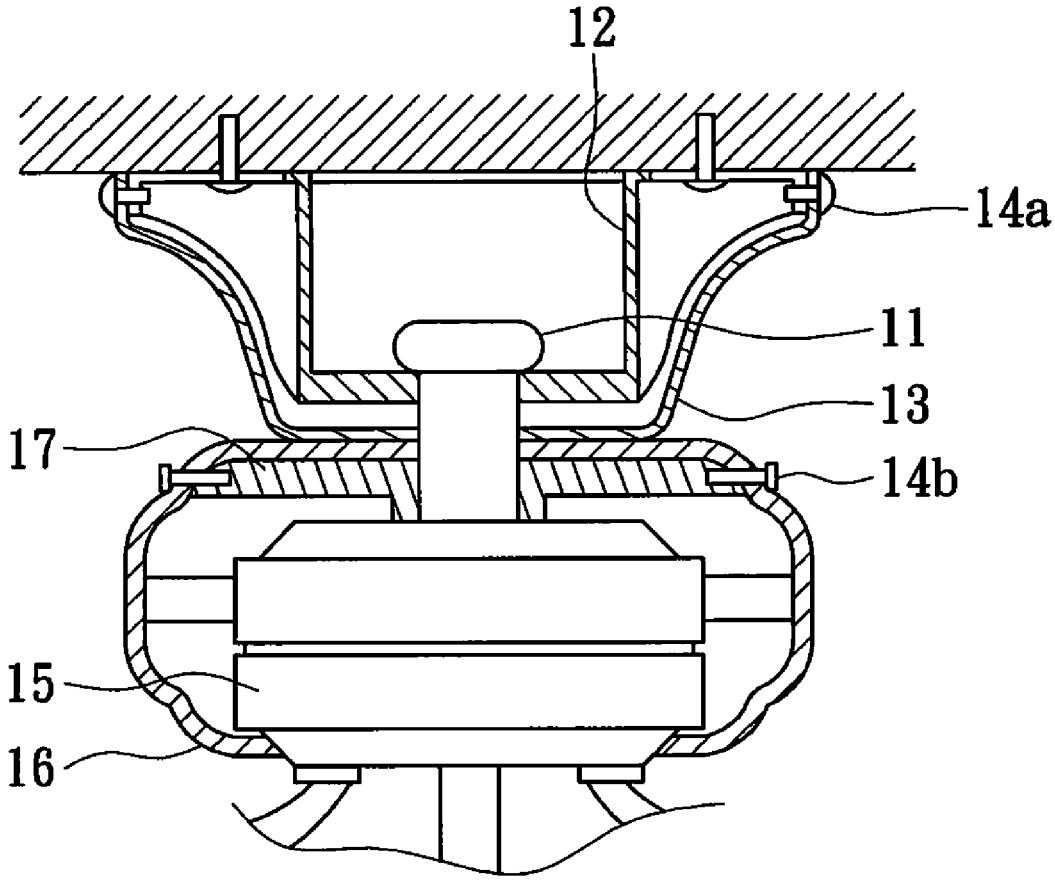
FIG. 1 PRIOR ART
FIG. 1 is a schematic view of the ceiling fan according to the prior art.
Figure 2:
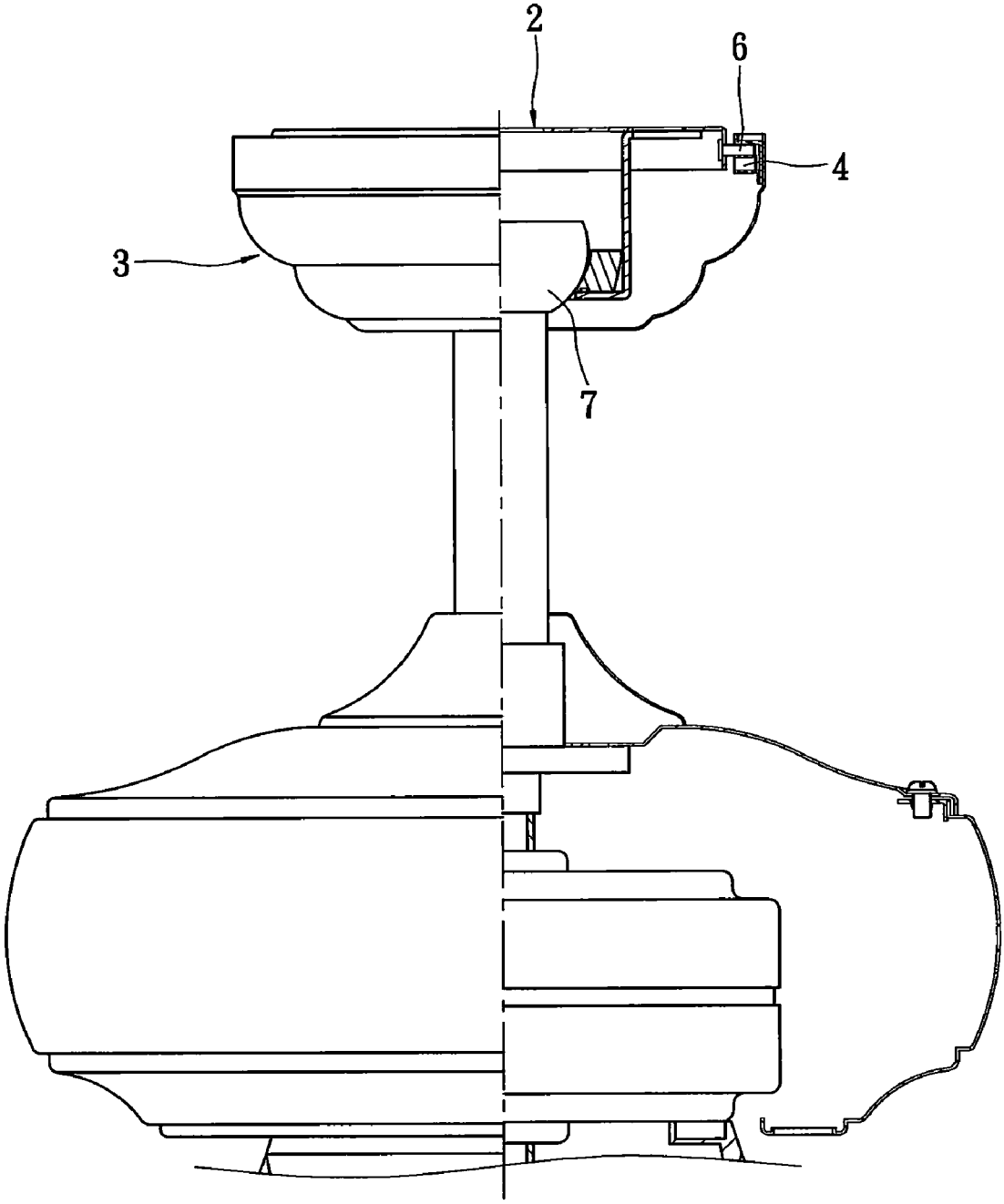
FIG. 2 is a partial front cross-sectional view of the ceiling fan positioning structure according to the first embodiment of the present invention.

Referring to FIG. 2, the first embodiment of the present invention provides a ceiling fan positioning structure for shielding a hanging portion 7 of a ceiling fan. The ceiling fan positioning structure includes a fixing frame 2, a decoration casing 3 and a plurality of retaining mechanisms 4.

Figure 3:
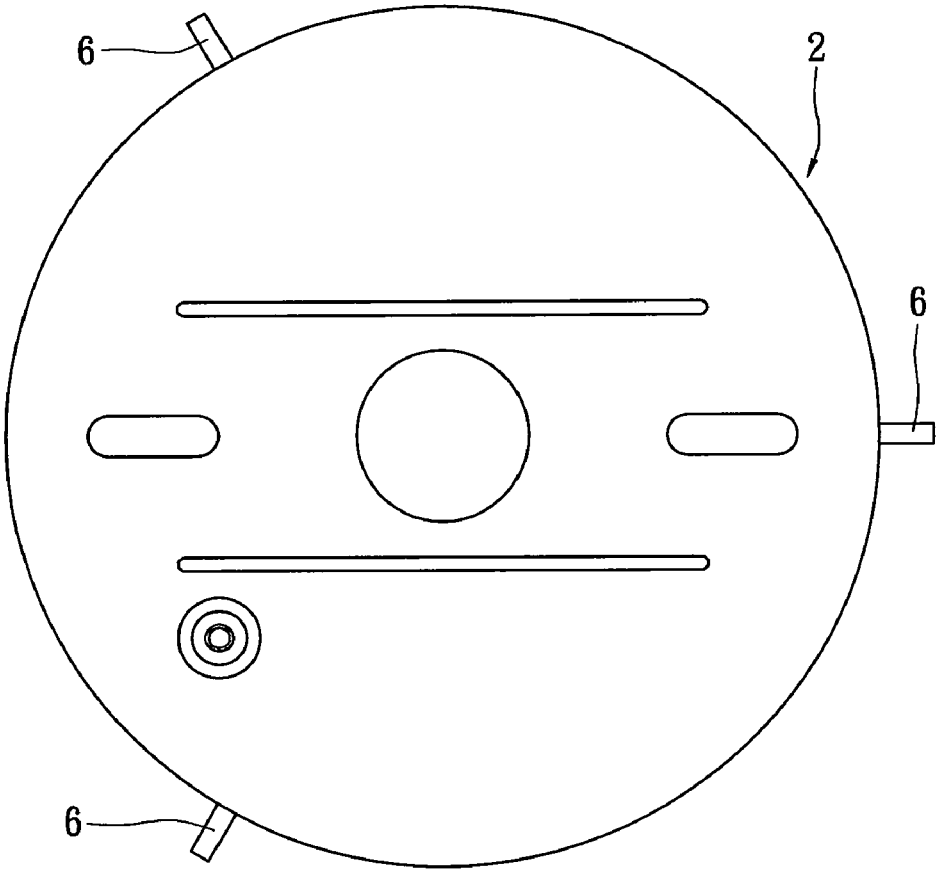
FIG. 3 is a top view of the fixing frame and the convex posts according to the first embodiment of the present invention.
Figure 4:
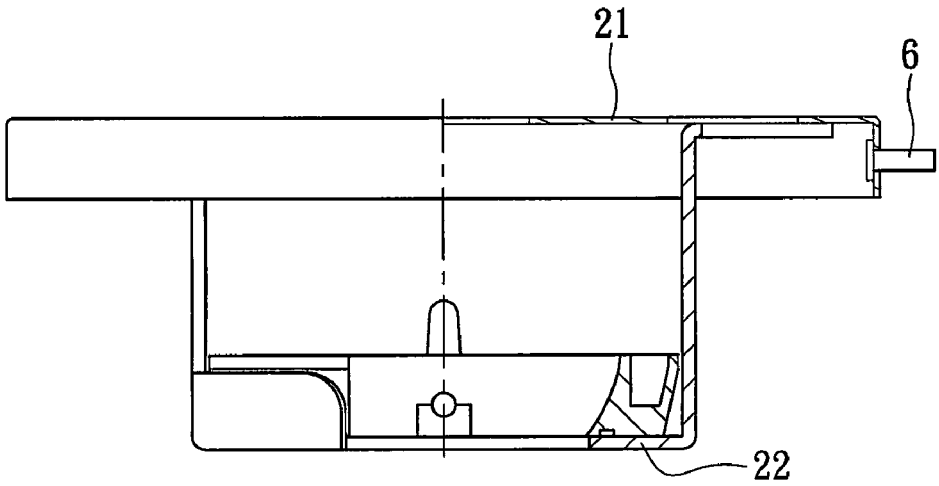
FIG. 4 is a partial cross-sectional view of FIG. 3.

The fixing frame 2 can be locked and fixed on a ceiling. The hanging portion 7 of the ceiling fan is fixed by the fixing frame 2. The fixing frame 2 has a plurality of convex posts 6 equidistantly disposed on an external portion thereof. In addition, the fixing frame 2 can be a two-piece structure or a single-piece structure. In the present invention, the fixing frame 2 is a two-piece structure. Referring to FIGS. 3 and 4, the fixing frame 2 has a top frame 21 and a bottom frame 22 connected with the top frame 21. The convex posts 6 are disposed on an external portion of the top frame 21. The hanging portion 7 of the ceiling fan is fixed by the bottom frame 22. Each convex post 6 is an independent component that passes through and fixed on the external portion of the top frame 21.

Figure 5:
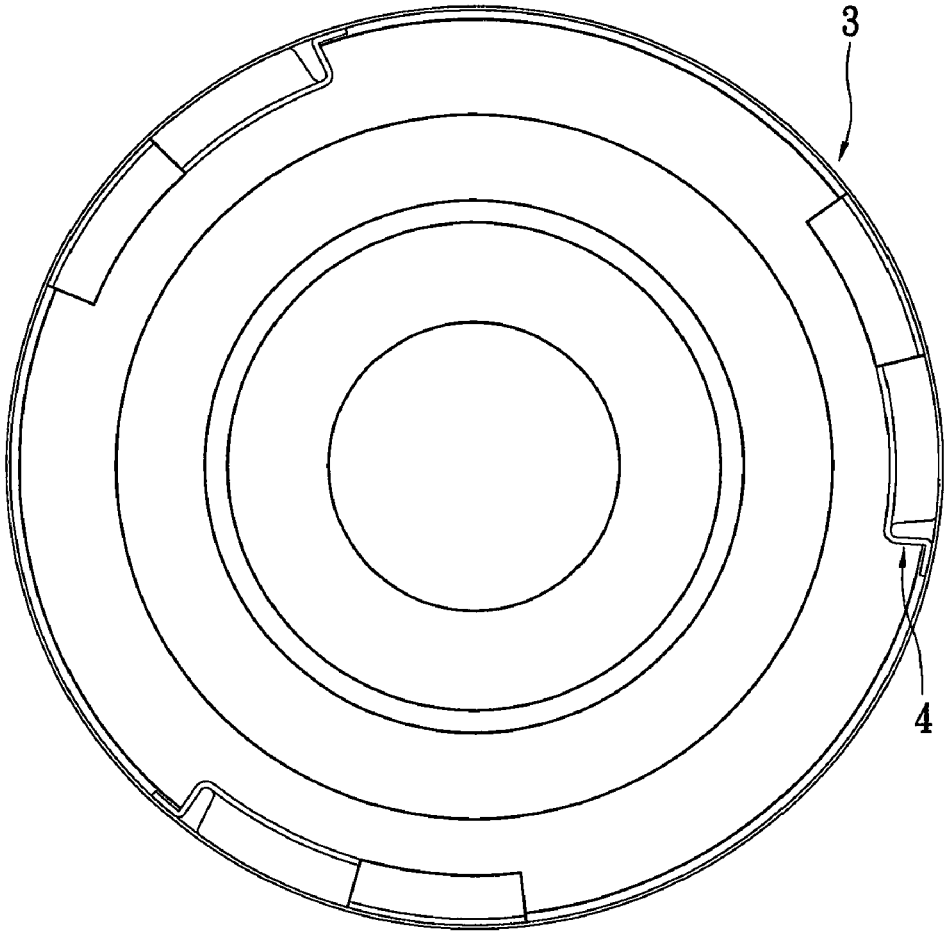
FIG. 5 is a top view of the decoration casing and the retaining mechanisms according to the first embodiment of the present invention.
Figure 6:
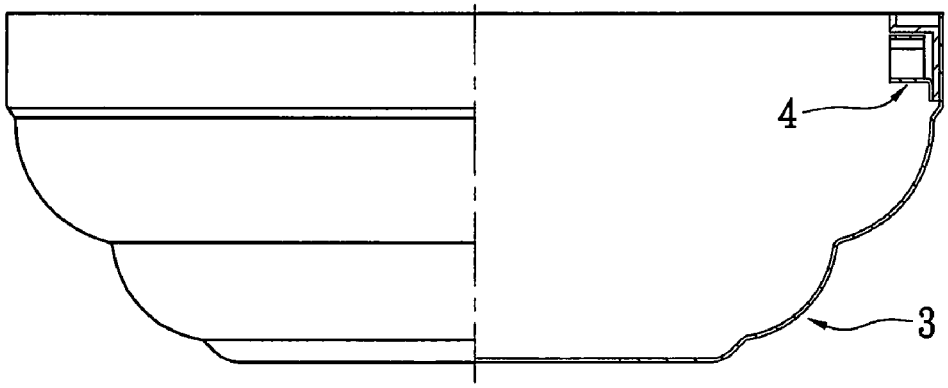
FIG. 6 is a partial cross-sectional view of FIG. 5.

Referring to FIGS. 5 and 6, the decoration casing 3 is a hollow casing for shielding the fixing frame 2 and the hanging portion 7. The shape of the decoration casing 3 in the figures does not limit the present invention.

Figure 7:
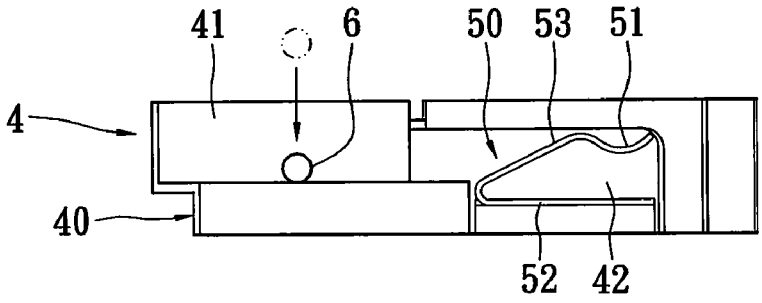
FIG. 7 is a first operation schematic view of the retaining mechanisms mated with the convex posts according to the first embodiment of the present invention.

The retaining mechanisms 4 are equidistantly fixed on a top portion of an inner wall of the decoration casing 3. Referring to FIG. 7, each retaining mechanism 4 has a base seat 40 and an elastic plate 50. The base seat 40 has a channel 41 and a chamber 42. The elastic plate 50 is disposed in the chamber 42. The elastic plate 50 has a pressing arm 51 bent on an end thereof. In addition, the elastic plate 50 has a fixing arm 52 fixing in the chamber 42 of the base seat 40 by welding or screwing and an elastic arm 53 bent and extended from one side of the fixing arm 52. The pressing arm 51 is bent and extended from an end of the elastic arm 53.

Referring to FIGS. 2 and 7 to 10, because the fixing frame 2 and hanging portion 7 have been assembled on the ceiling, the decoration casing 3 can be assembled on the fixing frame 2 from bottom to top in order to shield the fixing frame 2 and hanging portion 7.

Figure 8:
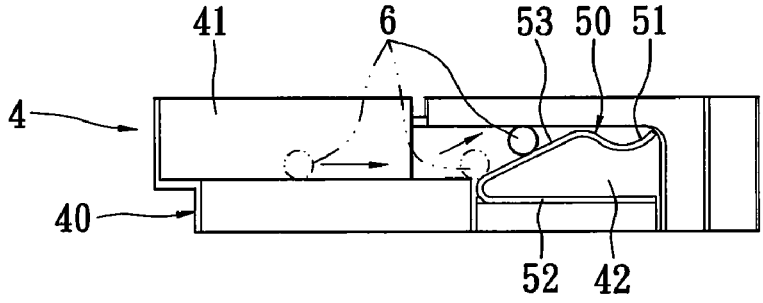
FIG. 8 is a second operation schematic view of the retaining mechanisms mated with the convex posts according to the first embodiment of the present invention.
Figure 9:
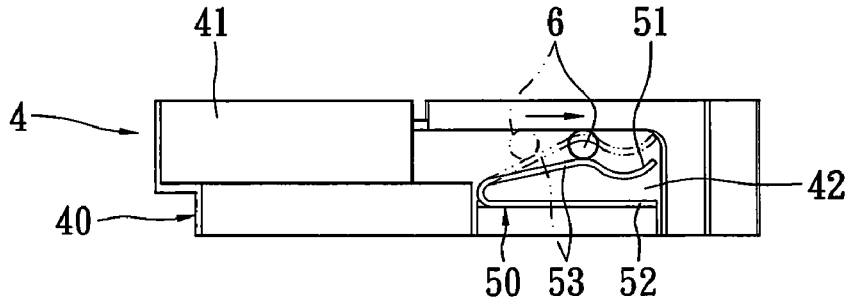
FIG. 9 is a third operation schematic view of the retaining mechanisms mated with the convex posts according to the first embodiment of the present invention.
Figure 10:
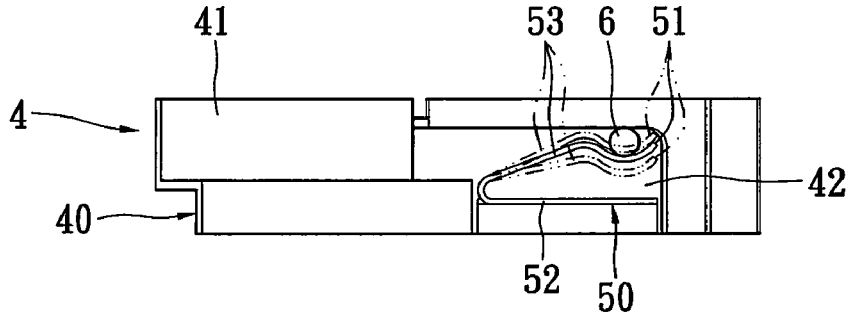
FIG. 10 is a fourth operation schematic view of the retaining mechanisms mated with the convex posts according to the first embodiment of the present invention.

When the decoration casing 3 is assembled on the fixing frame 2 for covering the fixing frame 2, each convex post 6 of the fixing frame 2 corresponds to each retaining mechanism 4 and each convex post 6 is received in the channel 41 of the base seat 40 of each retaining mechanism 4. When the decoration casing 3 is rotated, each convex post 6 is moved to each corresponding elastic plate 50 and into each corresponding chamber 42 as shown in FIG. 8. When the decoration casing 3 is continuously rotated, each convex post 6 touches each elastic arm 53 of each corresponding elastic plate 50 and the shape of each elastic plate 50 is changed to generate a predetermined elastic force as shown in FIG. 9. When the decoration casing 3 is further continuously rotated by a predetermined angle, each convex post 6 is moved to touch each pressing arm 51 and an inner wall of the chamber 42. Hence, the position of each convex post 6 is limited between each pressing arm 51 and the inner wall of each chamber 42 by the elastic force of each pressing arm 51. Therefore, it is convenient for user to assemble the decoration casing 3 on the fixing frame 2 by matching the convex posts 6 of the fixing frame 2 and the base seats 40 and the elastic plates 50 of the decoration casing 3.

Figure 11:
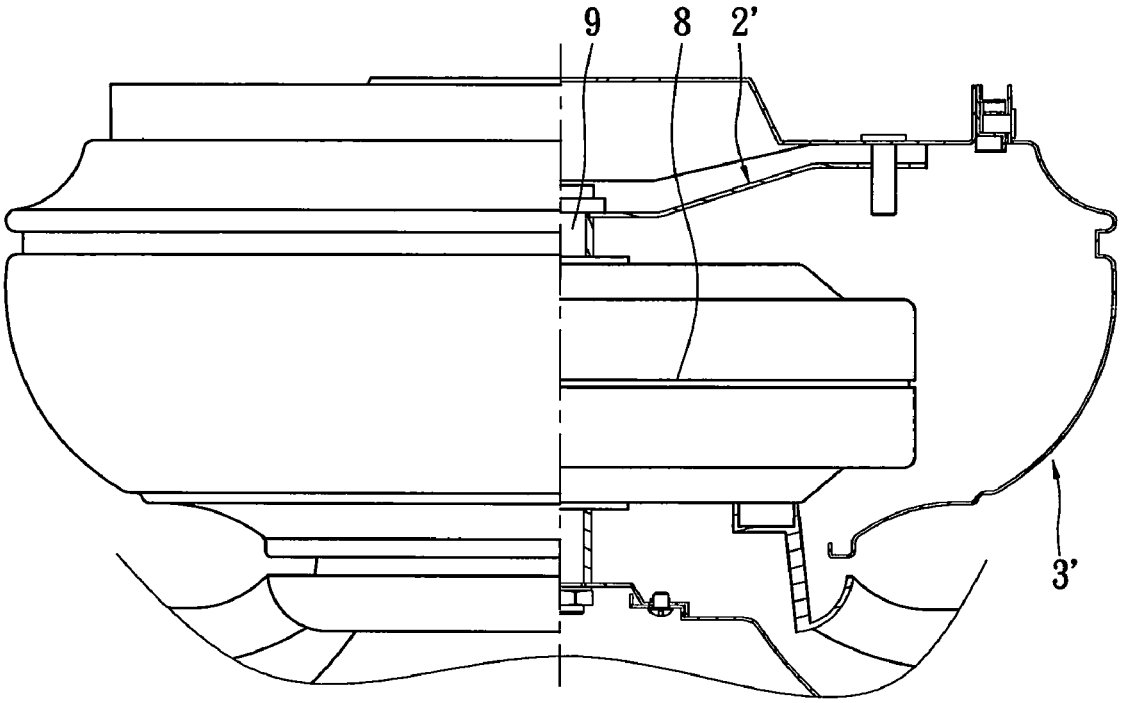
FIG. 11 is a partial front cross-sectional view of the ceiling fan positioning structure according to the second embodiment of the present invention.
Figure 12:
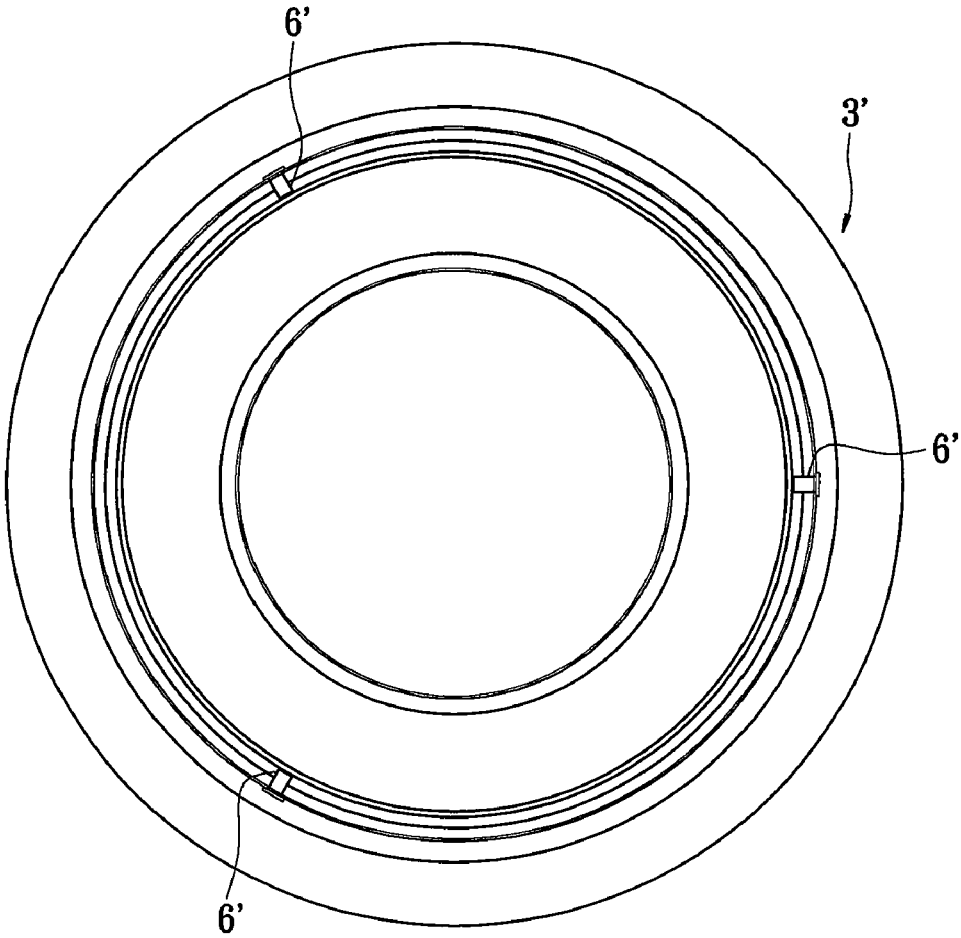
FIG. 12 is a top view of the decoration casing and the convex posts according to the second embodiment of the present invention.
Figure 13:
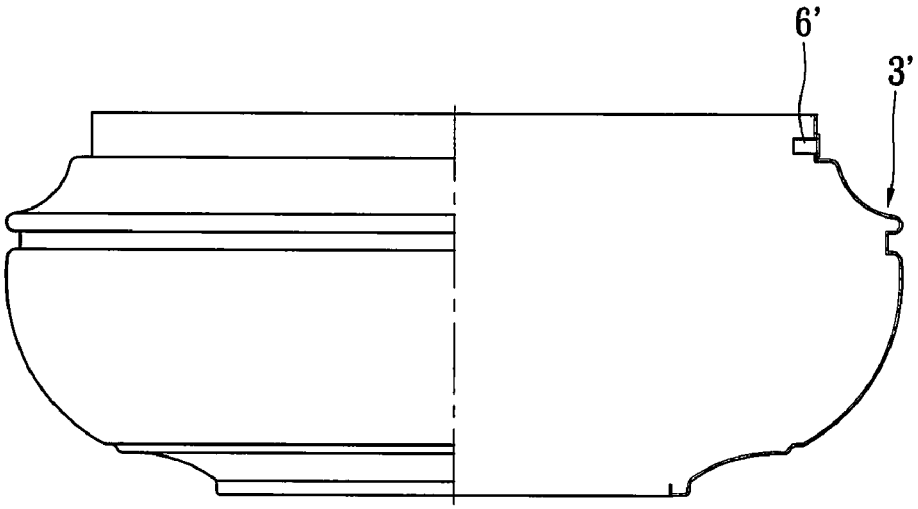
FIG. 13 is a partial cross-sectional view of FIG. 12.
Figure 14:
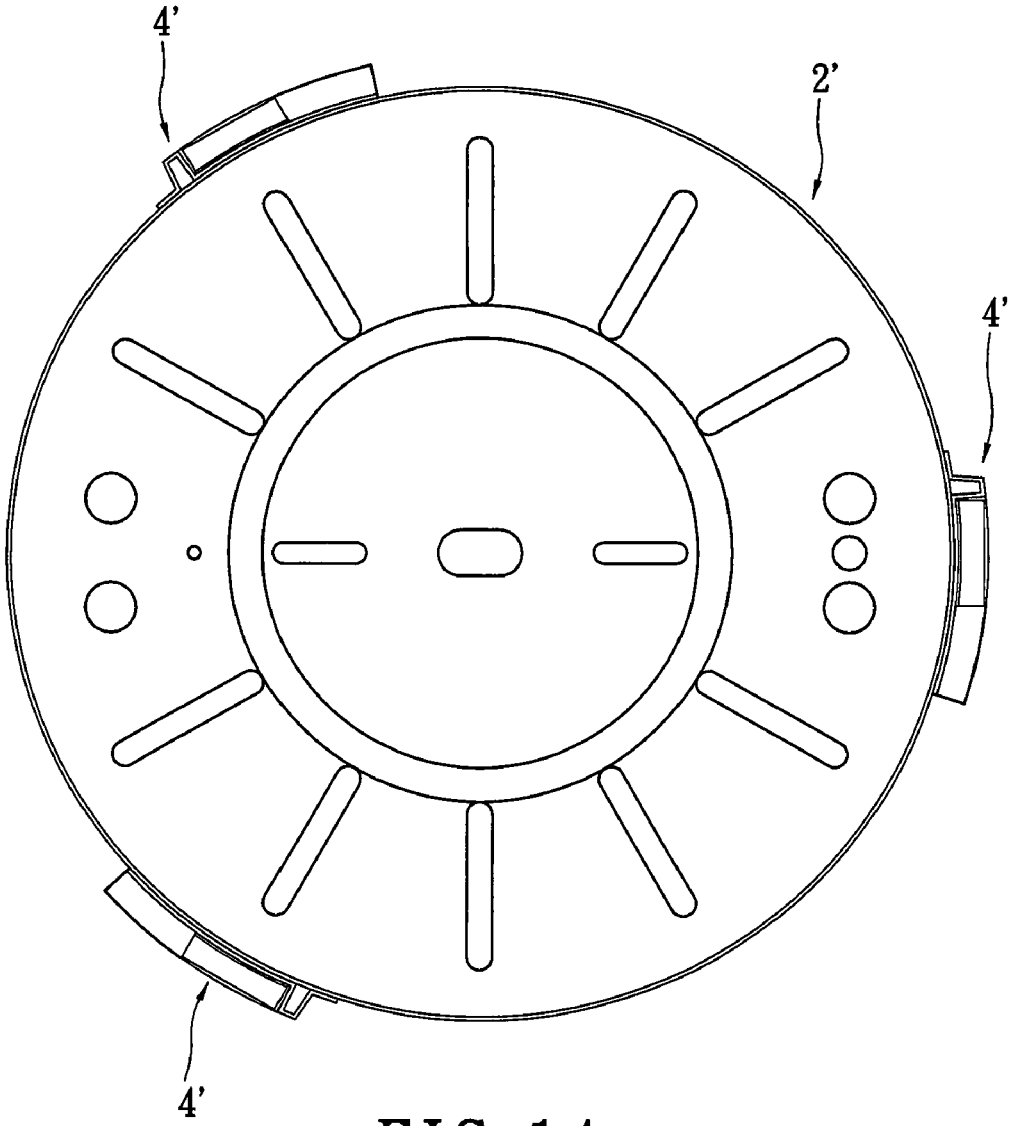
FIG. 14 is a top view of the fixing frame and the retaining mechanisms according to the second embodiment of the present invention.
Figure 15:
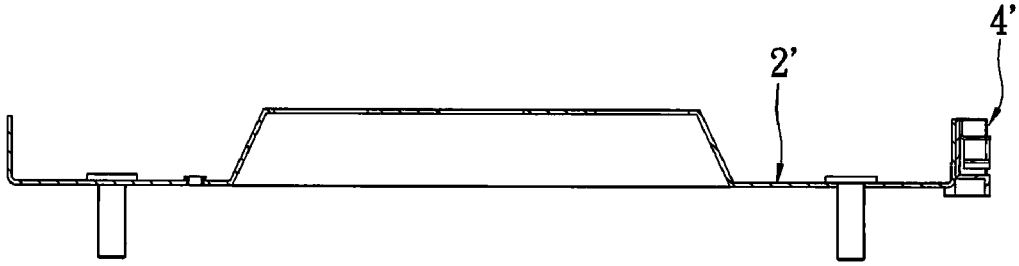
FIG. 15 is a partial cross-sectional view of FIG. 14.

Referring to FIG. 11, the second embodiment of the present invention provides a ceiling fan positioning structure for shielding a motor 8 of a ceiling fan. The second embodiment provides a two-piece fixing frame 2' that is the same as the fixing frame 2 of the first embodiment. The fixing frame 2' is fixed by a joint shaft 9 of the ceiling fan, and the joint shaft 9 is connected with the motor 8.

Referring to FIGS. 11 to 15, the difference between this embodiment and the above-mentioned embodiment is that: the decoration casing 3' has a plurality of convex posts 6' equidistantly projected inwards and disposed on a top portion of an external portion thereof. The retaining mechanisms 4' are equidistantly fixed on an external portion of the fixing frame 2'.

When the motor 8 wants to be shielded by the decoration casing 3', the decoration casing 3' can be moved from bottom to top and the convex posts 6' of the decoration casing 3' corresponds to the retaining mechanisms 4' of the fixing frame 2'.

Figure 16:
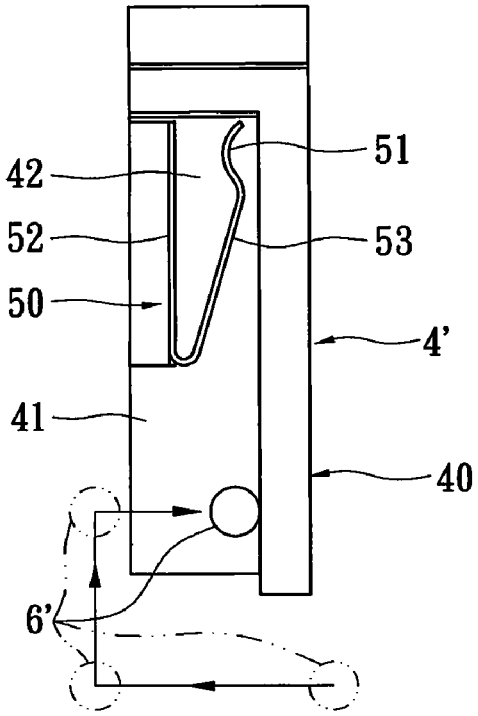
FIG. 16 is a first operation schematic view of the retaining mechanisms mated with the convex posts according to the second embodiment of the present invention.
Figure 17:
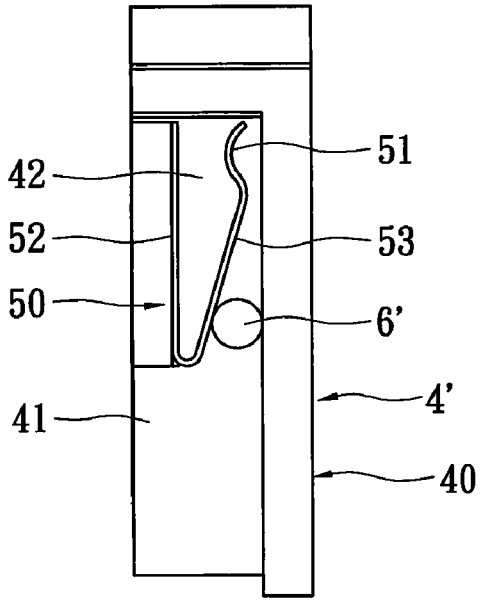
FIG. 17 is a second operation schematic view of the retaining mechanisms mated with the convex posts according to the second embodiment of the present invention.
Figure 18:
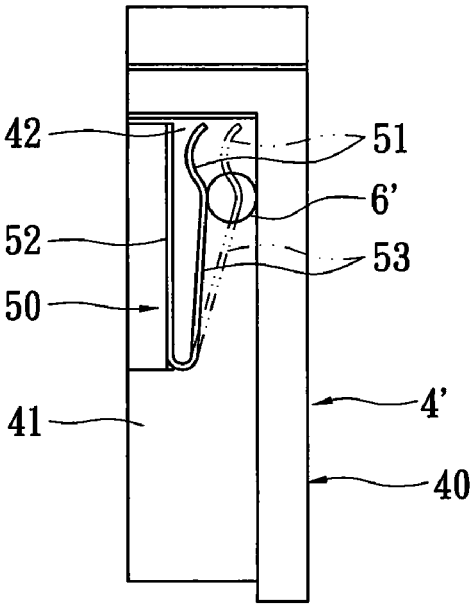
FIG. 18 is a third operation schematic view of the retaining mechanisms mated with the convex posts according to the second embodiment of the present invention.
Figure 19:
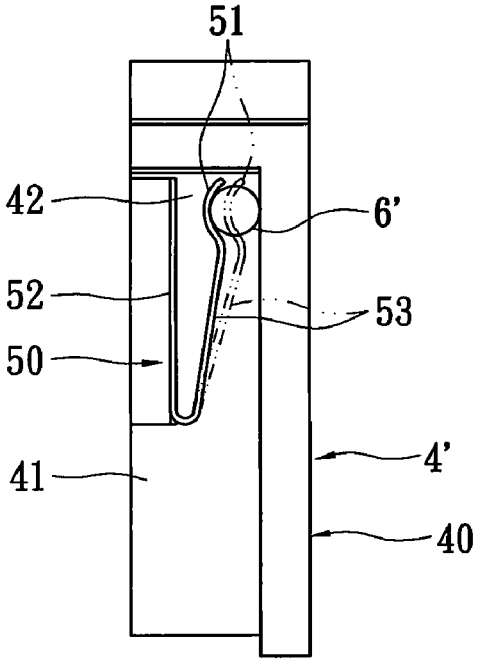
FIG. 19 is a fourth operation schematic view of the retaining mechanisms mated with the convex posts according to the second embodiment of the present invention.

Referring to FIGS. 16 to 19, each convex post 6' can be received in the channel 41 of the base seat 40 of each retaining mechanism 4' as shown in FIG. 16. When the decoration casing 3' is continuously rotated, each convex post 6' touches each elastic arm 53 of each corresponding elastic plate 50 as shown in FIG. 18. When the decoration casing 3' is further continuously rotated by a predetermined angle, each convex post 6' is moved to touch each pressing arm 51 and an inner wall of the chamber 42. Hence, the position of each convex post 6' is limited between each pressing arm 51 and the inner wall of each chamber 42 by the elastic force of each pressing arm 51. Therefore, it is convenient for user to assemble the decoration casing 3' on the fixing frame 2' by matching the convex posts 6' of the decoration casing 3' and the base seats 40 and the elastic plates 50 of the fixing frame 2'.

Furthermore, when the decoration casing (3 or 3') is reversely rotated, the decoration casing (3 or 3') is separated from the pressing arms 51 of the elastic plates 50 and from the channels 41 of the base seats 40 in sequence in order to detach the decoration casing (3 or 3') from the ceiling fan positioning structure.

Therefore, it is convenient for user to assemble the decoration casing with the fixing frame by matching the convex posts, the base seats and the elastic plates. In other words, the decoration casing and the fixing frame can be combined by rotating the convex posts to retain in the retaining mechanisms, so that it is convenient and simple for assembler to quickly and smoothly assemble the ceiling fan positioning structure on the ceiling.

The above-mentioned descriptions represent merely the preferred embodiment of the present invention, without any intention to limit the scope of the present invention thereto. Various equivalent changes, alternations or modifications based on the claims of present invention are all consequently viewed as being embraced by the scope of the present invention.

What is claimed is:

1. A ceiling fan positioning structure for hiding a hanging portion of a ceiling fan, comprising:

a fixing frame including a plurality of fixing convex posts fixedly disposed on an external portion thereof, wherein the hanging portion is retained by the fixing frame; and a decoration casing including a plurality of retaining mechanisms disposed on an inner wall thereof for respectively receiving the fixing convex posts, wherein the decoration casing is positioned on the fixing frame for hiding the fixing frame and the hanging portion by matching the fixing convex posts and the retaining mechanisms;

wherein each retaining mechanism includes a base seat fixed on the inner wall of the decoration casing and an elastic piece received in the base seat, and the elastic piece has a fixing arm fixed in the base seat and a movable elastic arm bent and extended from the fixing arm;

wherein each retaining mechanism is moved to receive each corresponding fixing convex post by rotating the decoration casing, and the movable elastic arm of the elastic piece of each retaining mechanism is pressed by each corresponding fixing convex post whereby the fixing convex post is abutted against an inner surface of the base seat by the movable elastic arm and the fixing convex post is positioned between the inner surface of the base seat and the elastic piece.

2. The ceiling fan positioning structure according to claim 1, wherein the fixing frame has a top frame and a bottom frame connected with the top frame, the fixing convex posts are disposed on an external portion of the top frame, and the hanging portion of the ceiling fan is fixed by the bottom frame.

3. The ceiling fan positioning structure according to claim 1, wherein the elastic piece has a movable pressing arm bent and extended from the movable elastic arm and each fixing convex post is positioned between the movable pressing arm of the elastic piece and the inner surface of the base seat of each corresponding retaining mechanism.

4. The ceiling fan positioning structure according to claim 3, wherein the movable elastic arm of the elastic piece of each retaining mechanism is pressed downwardly by each corresponding fixing convex post whereby the movable elastic arm is moved toward the fixing arm, and each fixing convex post has two contacting surfaces respectively contacting the movable pressing arm of the elastic piece and the inner surface of the base seat of each corresponding retaining mechanism.

5. A ceiling fan positioning structure for hiding a motor of a ceiling fan, comprising:

a fixing frame including a plurality of retaining mechanisms disposed on an external portion thereof, wherein the fixing frame is fixed by a joint shaft of the ceiling fan; and a decoration casing including a plurality of fixing convex posts fixedly disposed on an inner wall thereof to respectively insert into the retaining mechanisms, wherein the decoration casing is positioned on the fixing frame for hiding the motor by matching the fixing convex posts and the retaining mechanisms;

wherein each retaining mechanism includes a base seat fixed on the external portion of the fixing frame and an elastic piece received in the base seat, and the elastic piece has a fixing arm fixed in the base seat and a movable elastic arm bent and extended from the fixing arm;

wherein each fixing convex post is moved to insert into each corresponding retaining mechanism by rotating the decoration casing, and each fixing convex post is moved to press the movable elastic arm of the elastic piece of each corresponding retaining mechanism whereby the fixing convex post is abutted against an inner surface of the base seat by the movable elastic arm and the fixing convex post is positioned between the inner surface of the base seat and the elastic piece.

6. The ceiling fan positioning structure according to claim 5, wherein the elastic piece has a movable pressing arm bent and extended from the movable elastic arm, and each fixing convex post is positioned between the movable pressing arm of the elastic piece and the inner surface of the base seat of each corresponding retaining mechanism.

7. The ceiling fan positioning structure according to claim 6, wherein the movable elastic arm of the elastic piece of each retaining mechanism is pressed downwardly by each corresponding fixing convex post whereby the movable elastic arm is moved toward the fixing arm, and each fixing convex post has two contacting surfaces respectively contacting the movable pressing arm of the elastic piece and the inner surface of the base seat of each corresponding retaining mechanism.

* * * * *